US006439150B1

(12) United States Patent
Murphy et al.

(10) Patent No.: US 6,439,150 B1
(45) Date of Patent: Aug. 27, 2002

(54) SHADE COVER ASSEMBLY

(76) Inventors: Michael Murphy, 33124 Case St., Lake Elsinore, CA (US) 92530; Donald M. Erb, Jr., 4457 Big Branch Rd., Shingle Springs, CA (US) 95682

( * ) Notice: Subject to any disclaimer, the term of this patent is extended or adjusted under 35 U.S.C. 154(b) by 0 days.

(21) Appl. No.: 09/917,124

(22) Filed: Jul. 27, 2001

Related U.S. Application Data

(60) Provisional application No. 60/221,385, filed on Jul. 28, 2000.

(51) Int. Cl.[7] ..... B63B 17/00
(52) U.S. Cl. ..... 114/361; 135/88.01
(58) Field of Search ..... 114/361; 135/88.01

(56) References Cited

U.S. PATENT DOCUMENTS 4,641,600 A * 2/1987 Halvorsen ..... 114/202
5,983,824 A * 11/1999 Hernandez ..... 114/361
6,223,680 B1 * 5/2001 Frink et al. ..... 114/361

* cited by examiner

*Primary Examiner*—Jesus D. Sotelo
(74) *Attorney, Agent, or Firm*—Joseph E. Mueth

(57) ABSTRACT

A shade cover assembly adapted to be carried on a tower above the cockpit area of a pleasure boat, said shade cover assembly including a generally opaque cover, a cover fixture adapted to be carried by said tower for containing the cover in a rolled up state when in the retracted position and a frame for tensioning said cover when said cover is withdrawn from said fixture and is extended in a generally horizontal position above the cockpit area.

14 Claims, 5 Drawing Sheets

SHADE COVER ASSEMBLY

This patent application claims the benefit of Provisional Patent Application No. 60/221,385, filed Jul. 28, 2000.

BACKGROUND OF THE INVENTION

Pleasure power boats such as ski boats and fishing boats are oftimes provided with shade covers over the cockpit area to protect the boat operator from the sun. Generally, these shade covers are secured to the deck of the boat and are cumbersome and time consuming to install and remove. Consequently, in many cases, the shade cover once installed is left in place.

There are several disadvantages to such an arrangement. The boat operator does not have the option of removing or retracting the shade cover when coverage is not desired. Also, the essentially permanently deployed shade cover is subject to the elements of wind, rain and sun, reducing its useful life. Further, since pleasure boats are routinely removed from the water and towed by automobile, the shade cover creates noise and drag when it catches and flaps in the breeze as it is towed at high speed.

SUMMARY OF INVENTION

Briefly, this invention comprises a shade cover assembly adapted to be carried on a tower above the cockpit area of a pleasure boat, said shade cover assembly including a generally opaque cover, a cover fixture adapted to be carried by said tower for containing the cover in a rolled up state when in the retracted position and a frame for tensioning said cover when said cover is withdrawn from said fixture and is extended in a generally horizontal position above the cockpit area.

This invention further comprehends a power boat having a tower above the cockpit area, and a shade cover assembly including a generally opaque cover, a cover fixture carried by said tower for containing the cover in a rolled up state when in the retracted position and a frame for tensioning said cover when said cover is withdrawn from said fixture and is extended in a generally horizontal position above the cockpit area.

The shade cover assembly of this invention mounts to the boat tower with the aid of additional support or frame that extends above the boat deck and is carried by the tower. This shade cover extends horizontally forward and aft similar to pull down window shades that extend from a spring loaded tension device. It functions by rolling forward and retracting, allowing protective storage and convenience of space and time. It utilizes a three-sided generally rectilinear frame to support the shade cover when extended in the position of use.

The tower structure itself is known and has been used to provide a high tow point for attachment of the rope used to tow a water skier. The tower structure has also been used to carry radar, audio systems, boom boxes and the like. The tower structure is sometimes referred to as a "ski tower".

THE DRAWINGS

Figure 7A:
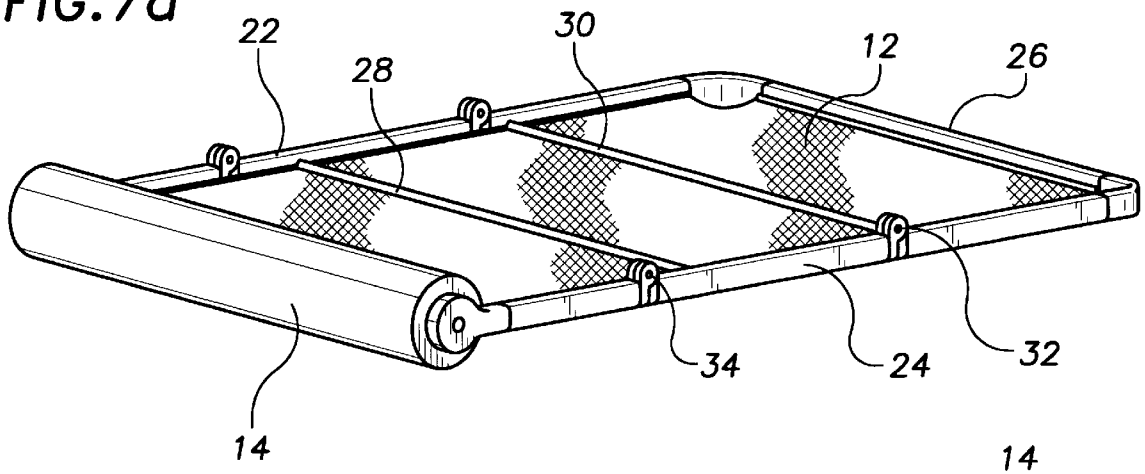

FIG. 7*a*, in perspective, greater detail of the shade cover assembly in the extended position.

Figure 7C:
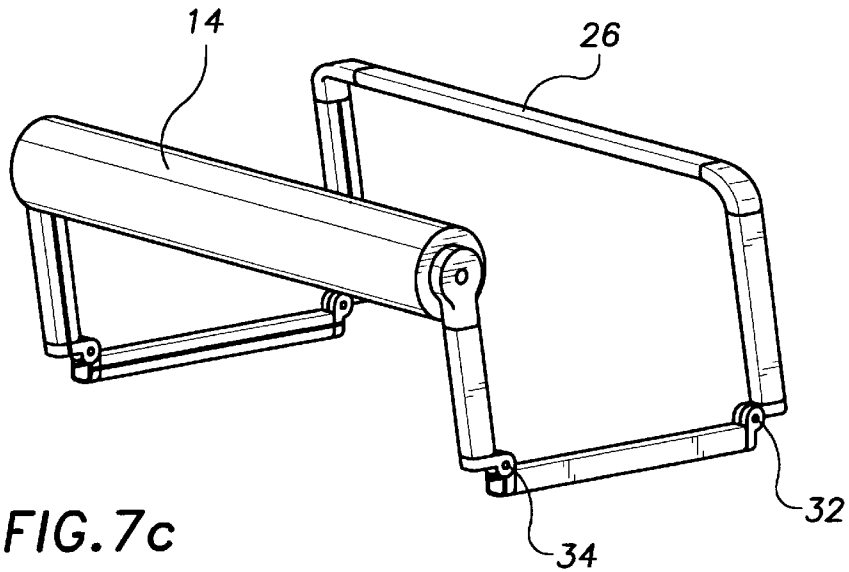
Figure 7B:
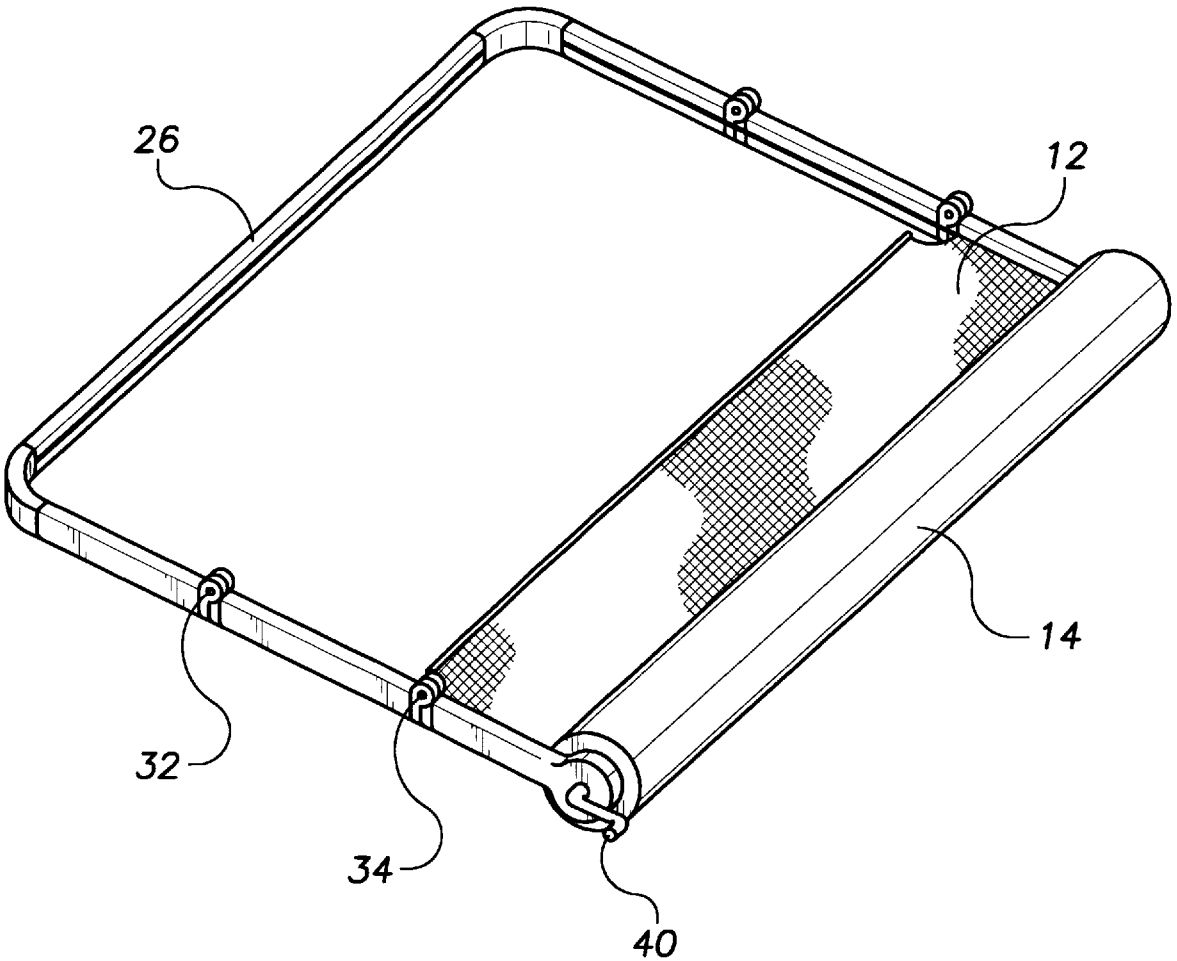

FIG. 7*b* shows, in perspective, greater detail of the shade cover assembly with the tower shade top in the partially extended position.

FIG. 7*c* shows, in perspective, greater detail of the shade cover assembly in the retracted and folded position.

DESCRIPTION OF THE PREFERRED EMBODIMENT

The invention relates to boat shade also known as bimini top used on waterski, fishing and recreational boats. These boats are typically about 14–40' long. Traditionally, boat shades used on waterski and other recreational boats have been of a fold out type, mounted and secured to the deck of the boat. These are time consuming to set up and break down and are left exposed to the elements. The tramp type shades used upon fishing boats, are usually permanently set up and consist of a 25–30 minute removal time, and do not allow the option of converting between preferences for sun exposure while the boat is in motion. The shade cover assembly of the present invention is much easier to use and more easily accommodates the boat operator and passengers preference for shade.

Turning to the drawings in greater detail.

The shade cover assembly 10 includes a generally opaque cover 12, a cover fixture 14, preferably an elongated cylindrical enclosure slotted to allow the cover 12 to pass, carried by a tower 16 above the cockpit area 18 of boat 20.

The cover fixture 14 for cover 12 is carried in a generally transverse position with respect to the longitudinal dimension of the hull of boat 20. The cover 12 is carried at one end by the cover fixture 14 and at its sides by side frame members 22 and 24, and is adapted to be fastened or tensioned, such as by hooks, to the front frame member 26.

Transverse battens 28 and 30 may be provided to increase the tension in cover 12. The battens are removable to permit folding of the frame assembly.

The cover 12 may be made of canvas or any other material which is at least partially effective in blocking sunlight. In this sense, the cover is said to be opaque. The cover 12 is generally square or rectangular in shape.

Figure 1:
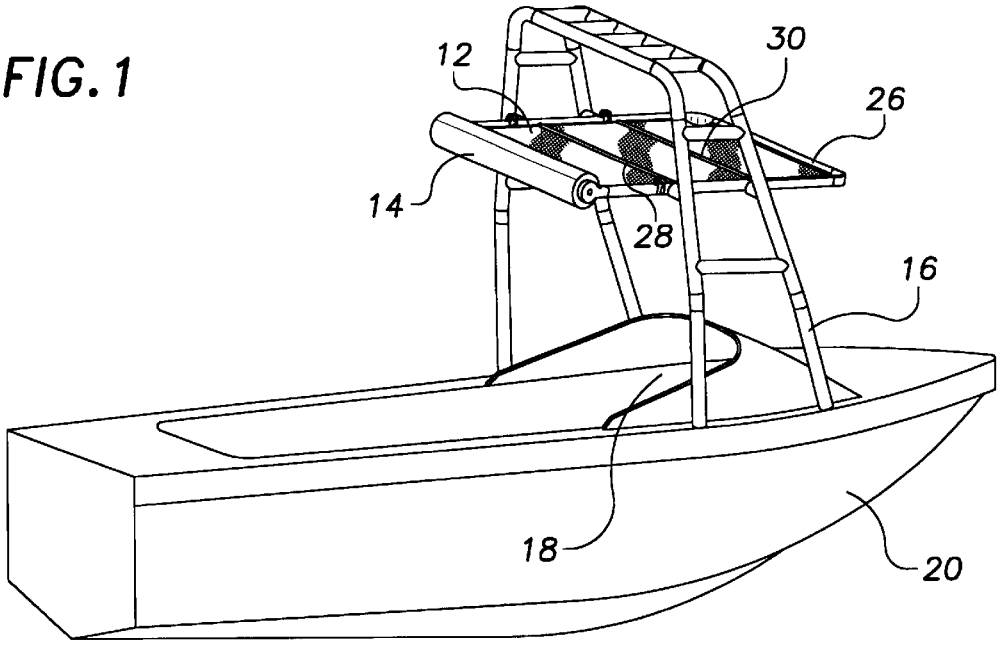
FIG. 1 is a perspective view showing the starboard, aft and top of a power boat with the tower carrying the shade cover assembly of this invention. The generally opaque cover is shown in the extended position above the cockpit.
Figure 2:
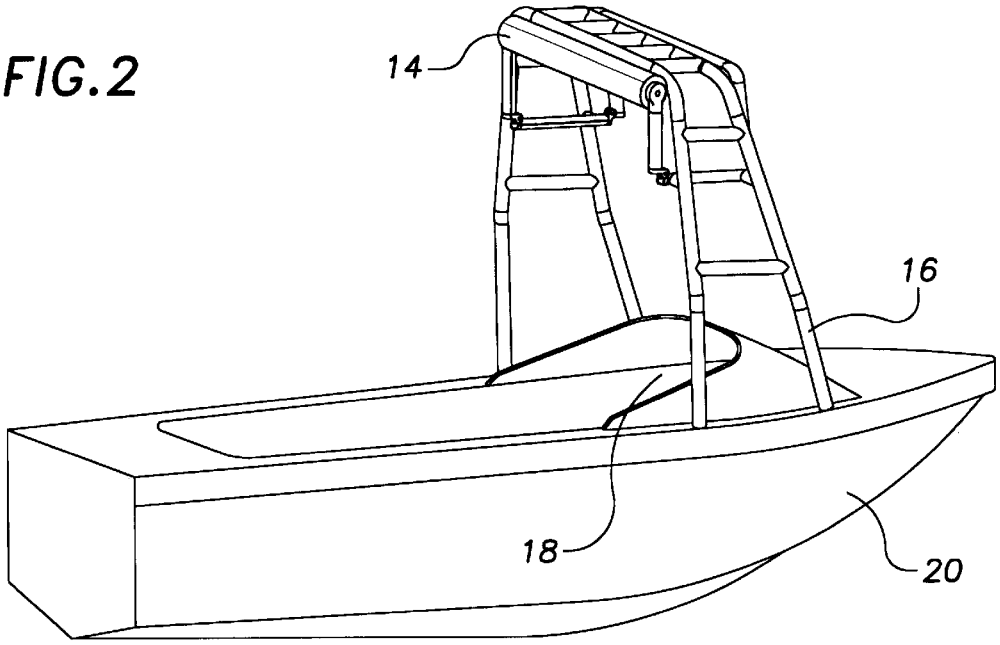
FIG. 2 is the same perspective view as FIG. 1 with the shade cover assembly of this invention shown in the retracted and folded position.
Figure 4:
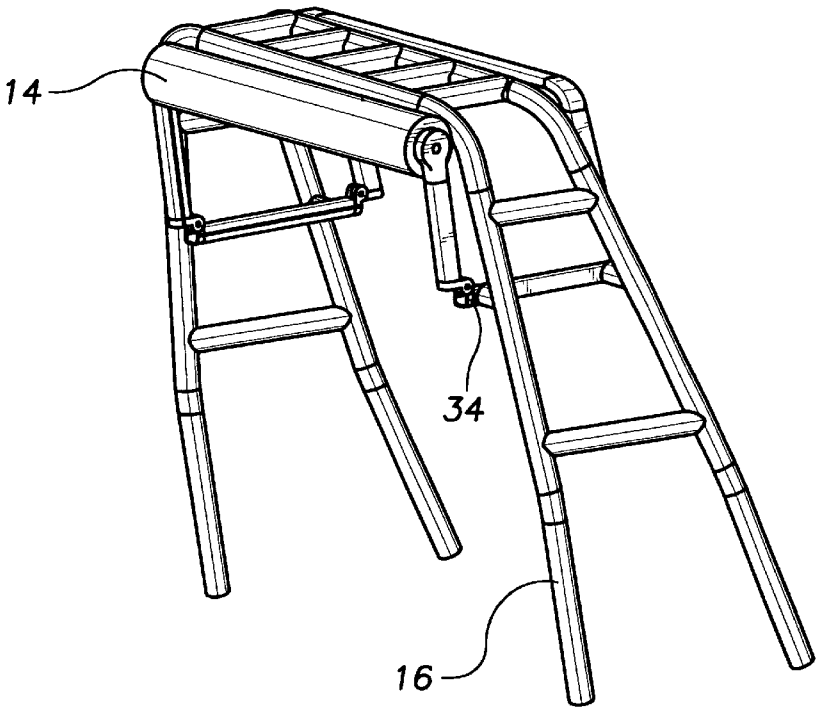
FIG. 4 is an enlarged perspective view of the tower and shade cover assembly shown in FIG. 2 showing the cover retracted and folded.
Figure 3:
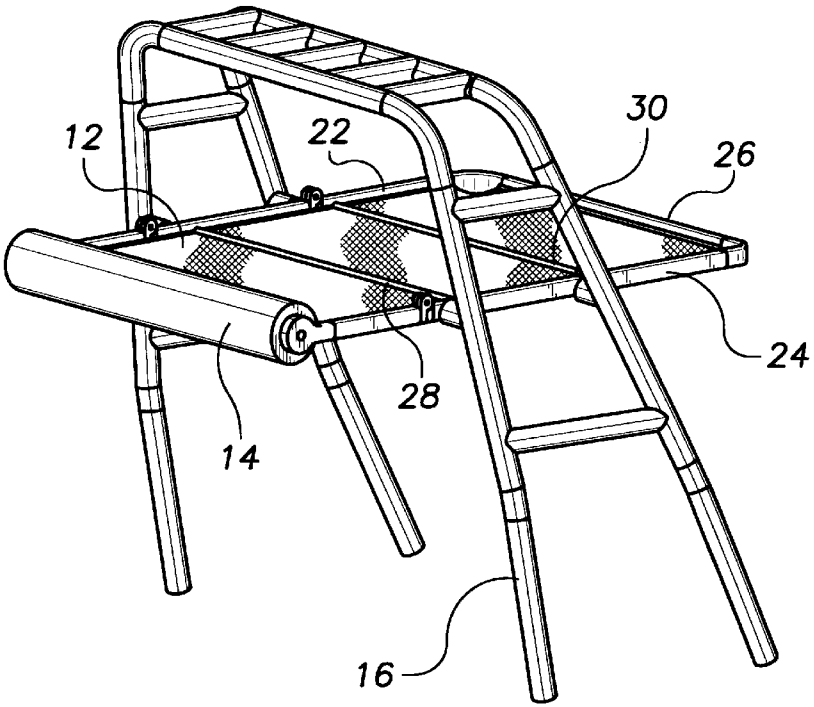
FIG. 3 is an enlarged perspective view of the tower and shade cover assembly shown in FIG. 1 showing the cover extended and battened.

The shade assembly can be extended as shown in FIGS. 1 and 3, or folded as shown in FIGS. 2 and 4. The side frame members 22 and 24 each having two over center hinges, front hinge 32 and rear hinge 34. The over center hinges can be folded up but not down and serve to keep the cover 12 and all of the frame elements flat or planar when in the extended position.

Figure 5:
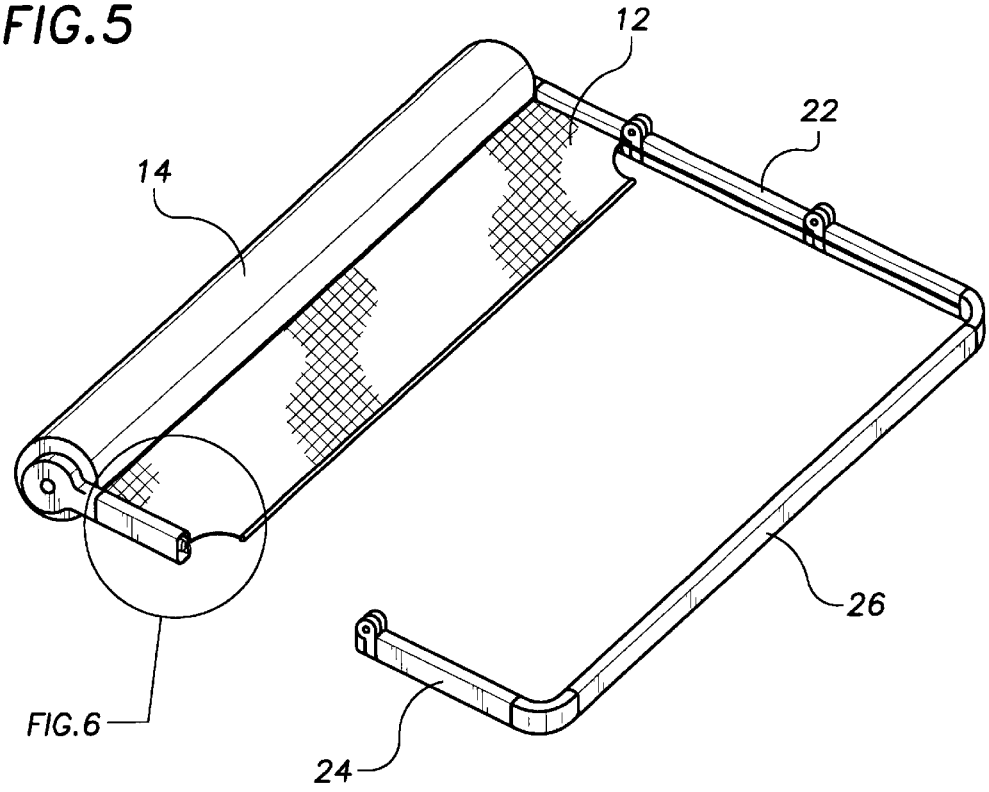
FIG. 5 is a perspective view of the shade cover assembly showing the cover partially extended.
Figure 6:
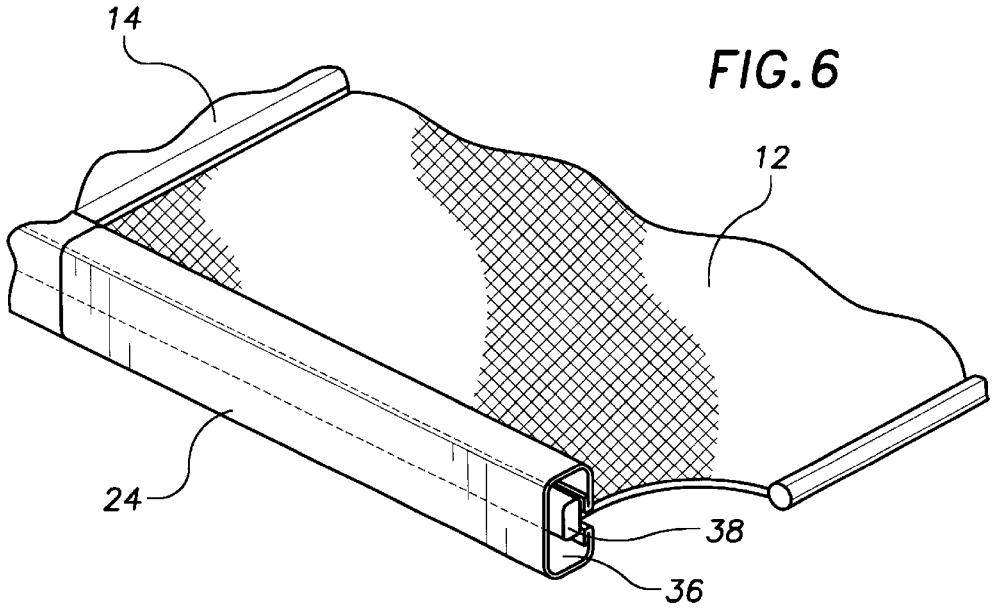
FIG. 6 shows in greater detail the structure within circle "A" in FIG. 5.

The side members 22 and 24 are preferably open channels 36 each slotted at its inner side in which is slidably received the side margins 38 of cover 12. The side margins 38 are generally folded over and sown or otherwise thickened so as to be received and held in place by channels 36, as shown in FIGS. 5 and 6. In this way, the cover 12 is held taut between side members 22 and 24.

When it is desired to deploy the shade cover 12, a hook or wire or other means for grasping and retaining, attached to the free end of the shade cover, and extending from the roll within fixture 14 is manually pulled forward until the means for grasping and retaining reaches front frame member 26 where the said means is secured to frame member 26. Thus, the shade cover 12 is also held taut between fixture 14 and frame member 26.

Within enclosure 14 there is provided a window shade mechanism so that when it is desired to retract shade cover 12, it is simply released from frame member 26, pulled forward slightly whereupon the cover 12 retracts by rolling up into fixture 14 on a spindle within fixture 14. Alternatively, the shade cover 12 can also be rolled up by use of a hand crank 40.

It is to be understood that the cover fixture 14 is preferably fairly water tight to protect the cover itself from the weather. However, if desired, fixture 14 can be partially or completely open so long as it is adapted to carry the cover 12 in a rolled up state.

Having fully described the invention, the following claims are intended to particularly point out and distinctly claim the invention.

We claim:

1. A shade cover assembly adapted to be carried on a tower above the cockpit area of a pleasure boat, said shade cover assembly including a generally opaque cover, a cover fixture adapted to be carried by said tower for containing the cover in a rolled up state when in the retracted position and a frame for tensioning said cover when said cover is withdrawn from said fixture and is extended in a generally horizontal position above the cockpit area, wherein said frame is generally rectilinear and said cover when extended is held at one of its ends by said cover fixture and at its sides and at its opposite end by said frame.

2. The shade cover assembly of claim 1 wherein said cover is generally square or rectangular.

3. The shade cover assembly of claim 1 wherein said frame can be folded up when said cover is in the retracted position.

4. The shade cover assembly of claim 1 wherein said cover is extendable from and retractable into said cover fixture like a window shade.

5. The shade cover assembly of claim 1 wherein said cover is retractable by a hand crank.

6. The shade cover of claim 1 wherein said cover fixture is a weather-proof cylinder slotted to permit passage of said cover.

7. A power boat having a tower above the cockpit area, and a shade cover assembly including a generally opaque -cover, a cover fixture carried by said tower for containing the cover in a rolled up state when in the retracted position and a frame for tensioning said cover when said cover is withdrawn from said fixture and is extended in a generally horizontal position above the cockpit area.

8. The power boat of claim 7 wherein said cover is generally square or rectangular.

9. The power boat of claim 7 wherein said frame is generally rectilinear and said cover when extended is held at one of its ends by said cover fixture and at its sides and at its opposite end by said frame.

10. The power boat of claim 7 wherein said frame can be folded up when said cover is in the retracted position.

11. The power boat of claim 7 wherein said cover is extendable from and retractable into said cover fixture like a window shade.

12. The power boat of claim 7 wherein said cover is retractable by a hand crank.

13. The power boat of claim 7 wherein said cover fixture is a weather-proof cylinder slotted to permit passage of said cover.

14. The power boat of claim 7 wherein said cover fixture is adapted to be carried by said tower generally transversely of the boat hull.

* * * * *